US006439419B1

(12) United States Patent
Darabi

(10) Patent No.: US 6,439,419 B1
(45) Date of Patent: Aug. 27, 2002

(54) COMBINED DRINKING CUP AND HORN

(76) Inventor: James S. Darabi, 1609 W. County Rd. 42, #131, Burnsville, MN (US) 55306

( * ) Notice: Subject to any disclaimer, the term of this patent is extended or adjusted under 35 U.S.C. 154(b) by 0 days.

(21) Appl. No.: 09/975,652

(22) Filed: Oct. 10, 2001

Related U.S. Application Data

(62) Division of application No. 29/134,507, filed on Dec. 22, 2000, now Pat. No. Des. 456,213.

(51) Int. Cl.[7] ..... B65D 23/00

(52) U.S. Cl. ..... 220/703; 220/DIG. 13; 215/382; D7/515; D7/516

(58) Field of Search ..... 220/703, 601, 220/DIG. 13; D7/515, 516; 229/379, 382

(56) References Cited

U.S. PATENT DOCUMENTS 1,832,806 A * 11/1931 Dawson ..... 220/703 X
4,832,213 A * 5/1989 Sharon et al. ..... 215/382 X
5,178,308 A * 1/1993 Endre ..... 220/DIG. 13 X
D370,831 S * 6/1996 Steinfels, III et al. ..... D7/536

* cited by examiner

*Primary Examiner*—Steven Pollard
(74) *Attorney, Agent, or Firm*—James W. Miller

(57) ABSTRACT

A combined drinking cup and horn comprises a generally L-shaped cup portion having a small diameter first end and a larger diameter second end. The second end of the cup portion is large enough to permit a user to drink from the cup portion through the second end thereof when a lid on the second end of the cup portion has been removed to expose a beverage contained in the cup portion. A mouthpiece is attached by a reduced diameter neck to the first end of the cup portion. An opening in the mouthpiece is normally closed by a removable stopper. When the cup portion is empty of the beverage, the user can then remove the stopper. The user can then blow through the mouthpiece to create a tonal sound similar to that provided by a horn. The combined drinking cup and horn could be sold at sporting events or the like for use at the event.

17 Claims, 2 Drawing Sheets

COMBINED DRINKING CUP AND HORN

CROSS REFERENCE TO RELATED APPLICATIONS

This application is a division of design patent application Ser. No. 29/134,507, filed Dec. 22, 2000, now U.S. Pat. D 456,213.

TECHNICAL FIELD

This invention relates to a novelty and entertainment item comprising a cup that may be used for drinking beverages and which when empty also serves as a sound generating horn.

BACKGROUND OF THE INVENTION

Various events are held which attract large crowds of patrons. Such events include sporting events such as football games. It is customary at such events for the fans of a particular team to support their team in various ways. One such way of supporting a team is to attempt to make noise in an effort either to urge on the team one wishes to support or to distract the opposing team.

In creating noise, fans often clap their hands, stamp their feet, or use their voices to shout or yell. Some fans on occasion might use an artificial noisemaker, but this is not typical.

It is also customary at sporting events for beverages to be sold to fans, usually either beer or non-alcoholic beverages such as soda pop. Such beverages are sold in conventional paper or plastic cups. Once the beverage is consumed, the cups are usually thrown away, though plastic cups may often be decorated with graphics and might be kept as souvenirs. The pick up and disposal of drinking cups that are discarded is a time consuming task for the operators of sports stadiums or ballparks.

It would be desirable for a fan at a sporting event to be able to purchase a beverage, to consume that beverage, and to then use the cup in which the beverage was sold as a horn for creating tonal sounds. Such a device would satisfy two needs, the need for a drinking cup and the need for something to use as a noisemaker. Such a device would often be kept as a souvenir, thus potentially decreasing the amount of trash that must be picked up and removed following the sporting event. However, such a device would be inexpensive enough to allow it be disposed of if the purchaser so desired.

Prior to this invention, such a combined drinking cup and horn did not exist. This invention satisfies the described needs.

The prior art does disclose the use of megaphone cups for holding beverages. After the beverage is drunk, the base of the cup can be removed to convert the cup into a megaphone. Once the cup is converted to a megaphone, the user can use it amplify the sound of the user's own voice. U.S. Pat. No. 5,967,405 to Hanauska shows a combined cup and megaphone of this type.

Megaphone cups of this type only provide amplification of the user's own voice. They do not provide means for generating non voice-like sounds. For example, they do not provide an ability to produce tonal sounds of the type that would be produced by a horn. Accordingly, they are not as effective or as desirable a noisemaker as many people would prefer.

Some drinking cups or containers include electronic sound generating devices. For example, U.S. Pat. No. 5,739,758 discloses a container having a lid that can be opened. When the lid is opened, a sound generating computer chip produces some type of sound that might encourage the user, such as a small child, to drink.

However, drinking cups using electronic sound generating devices would not generally be suitable for disposable one-time use. They would be relatively expensive due to the need to include the electronic components required to generate the desired sound as well as the need for a battery to power those components. Accordingly, they do not satisfy the need for an inexpensive drinking cup that can also produce a tonal sound but which is inexpensive enough to allow it to be disposed of after use.

U.S. Pat. No. 6,129,265 discloses a juice box type of beverage container having a whistle or horn therein. When the beverage has been drunk from the container, the straw can be left in the juice box. If an air passage in the whistle or horn is exposed, and if the user then induces a suction in the juice box by sucking on a straw left in the juice box, air will be induced to pass inwardly into the juice box through the whistle or horn. This will create a tonal sound.

Again, however, the juice box idea described above is ineffective as a practical noise maker. The space or volume of the juice box is quite constricted and sucking through a straw is an inefficient way of inducing a vacuum or suction in the juice box. The user can simply not move much air by sucking on a straw. Accordingly, the volume of any tonal sounds produced by the whistle or horn would be quite weak and more than likely would be overcome simply by the crowd sounds of those attending the sporting event. Moreover, drinking a beverage from a juice box through a straw is meant primarily for children and would not be used by adults to drink beverages such as beer or soda pop.

SUMMARY OF THE INVENTION

One aspect of this invention relates to a combined drinking cup and horn which comprises a cup portion for holding a beverage as a user drinks the beverage through an open end of the cup portion. A selectively openable mouthpiece is attached to the cup portion. A non-verbal sound is produced when the mouthpiece is opened after the beverage is emptied from the cup portion and the user blows through the mouthpiece in the manner of a horn.

Another aspect of this invention relates to a combined drinking cup and horn which comprises a cup portion for holding a beverage as a user consumes the beverage. A mouthpiece on the cup portion has an opening. A removable closure is provided on the opening of the mouthpiece to prevent the beverage from leaking from the cup portion through the mouthpiece as the beverage is being consumed. The mouthpiece and cup portion provide a tonal, horn-like sound when the user blows through the mouthpiece after the cup portion has been emptied of the beverage and the closure on the mouthpiece is removed.

Yet another aspect of this invention relates to a combined drinking cup and horn which comprises a cup portion for holding a beverage. The cup portion has a first end and a second end with circular cross-sections with the cross-section of the cup portion at the first end thereof being smaller than the cross-section of the cup portion at the second end thereof. The cross-section of the cup portion at the second end thereof is sufficiently large to allow a user to drink the beverage from the second end of the cup portion. A mouthpiece is attached to the first end of the cup portion through a reduced diameter neck. A closure is provided for the mouthpiece to prevent the beverage from passing out of the mouthpiece when a beverage is contained in the cup portion and the beverage is being consumed by the user. The closure is removable from the mouthpiece when the cup portion is empty to open the mouthpiece, the reduced diameter neck and the cup portion to allow the user to blow therethrough to create a tone.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
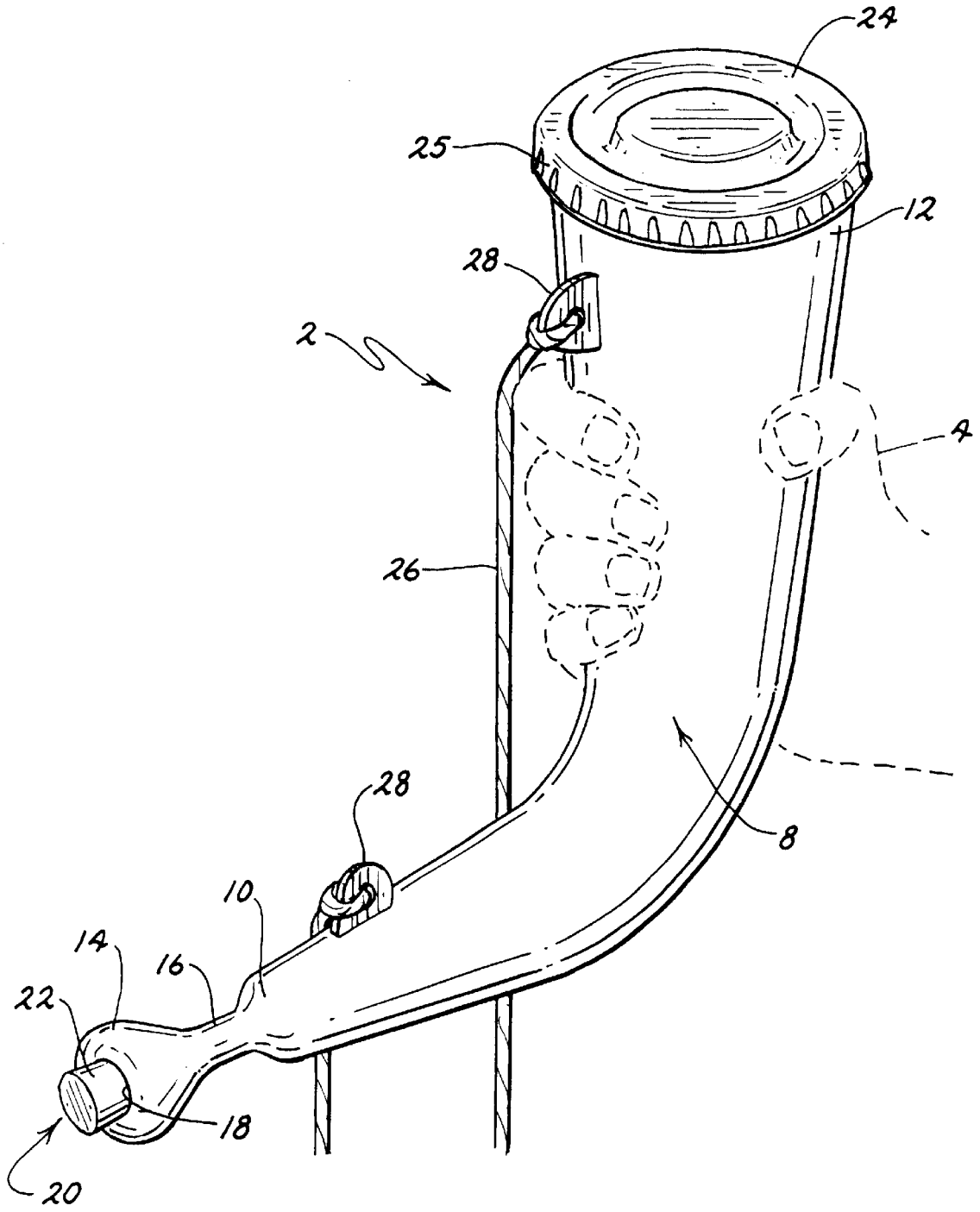
FIG. 1 is a perspective view of a combined drinking cup and horn according to this invention.

FIG. 1 shows a combined drinking cup and horn, referred to generally as 2, in the hand 4 of a user 6. Drinking cup and horn 2 comprises a generally L-shaped cup portion 8. Cup portion 8 has a progressively increasing cross-sectional size from one end of cup portion 8 to the other. If one were to take a plurality of cross-sections through cup portion 8 perpendicular to a longitudinal L-shaped axis extending from one end of cup portion 8 to the other, each cross-section would be a circular one. The diameters of the cross-sections would progressively increase from one end of cup portion 8 to the other.

Accordingly, a first end 10 of cup portion 8 is relatively narrow such that a circular cross-section through first end 10 of cup portion 8 would have a small diameter. Cup portion 8 then progressively tapers outwardly from first end 10 until one reaches a second end 12 of cup portion 8. Second end 12 of cup portion 8 is relatively wide such that cup portion 8 at second end 12 would have a diameter much larger than the diameter of cup portion 8 at first end 10 thereof. The diameter of cup portion 8 at second end 12 of cup portion 8 is one similar to many drinking cups sized to hold 12–24 ounces of beverage. For example, second end 12 of cup portion 8 can have a diameter of 3 to 5 inches or so, i.e. a diameter that is large enough to allow a user to easily and comfortably drink from second end 12 of cup portion 8.

As noted earlier, cup portion 8 is L-shaped meaning that first and second ends 10 and 12 of cup portion 8 are not aligned with one another, but are offset at approximately 90° relative to one another. While this L-shaped configuration of cup portion 8 is preferred, first and second ends 10 and 12 of cup portion 8 could be angled relative to one another at some angle other than 90° or could be even be in line with one another such that cup portion 8 is simply in the form of a straight tapered cone.

The first or small diameter end 10 of cup portion 8 includes a mouthpiece 14 connected thereto by a reduced diameter neck 16. Mouthpiece 14 has an opening 18 which is initially closed by some type of closure 20. One type of closure 20 that can be used is a removable stopper 22, such as a rubber stopper. However, other closures 20 could be used, such as removable paper coverings, pull-tabs, frangible plastic caps that could be broken off mouthpiece 14 to open opening 18 in mouthpiece 14, etc. While some type of closure 20 is required to prevent the beverage in cup portion 8 from leaking from cup portion 8, the type of closure 20 that is used is not important and can obviously be varied.

Second end 12 of cup portion 8 can include a removable lid 24 of the type commonly sold with cups for retaining the beverage in cup portion 8 to prevent the beverage from spilling from cup portion 8. As shown in FIG. 1, lid 24 simply fits down over the normally open second end 12 of cup portion 8 with a flange 25 of lid 24 lightly clamping around the rim of second end 12 of cup portion 8. When user 6 wishes to drink from cup portion 8, user 6 simply lifts lid 24 off second end 12 of cup portion 8 to expose the beverage contained in cup portion 8.

A strap or cord 26 is preferably provided on cup portion 8 with the ends of strap or cord 26 being tied to two eyelets 28 adjacent either end of cup portion 8. Strap or cord 26 allows user 6 to retain drinking cup and horn 2 around the user's neck after cup portion 8 has been emptied of its beverage and user 6 desires to use it as a horn. Other methods of attaching strap or cord 26 to cup portion 8 could be used in place of eyelets 28. While the use of a strap or cord 26 is preferred, such a strap or cord 26 could obviously be deleted if so desired.

Figure 3:
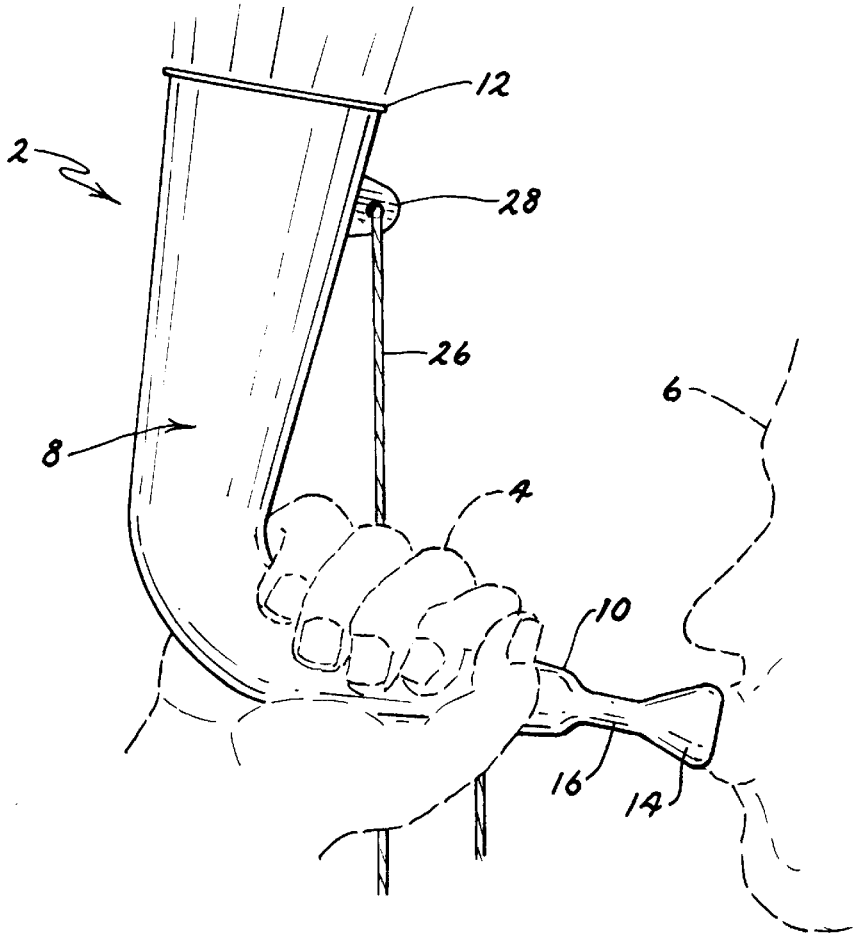
FIG. 3 is a side elevational view of the combined drinking cup and horn of FIG. 1, particularly illustrating use as a horn for producing a tonal sound after the beverage initially contained inside the cup has been emptied or drunk from the cup.
Figure 2:
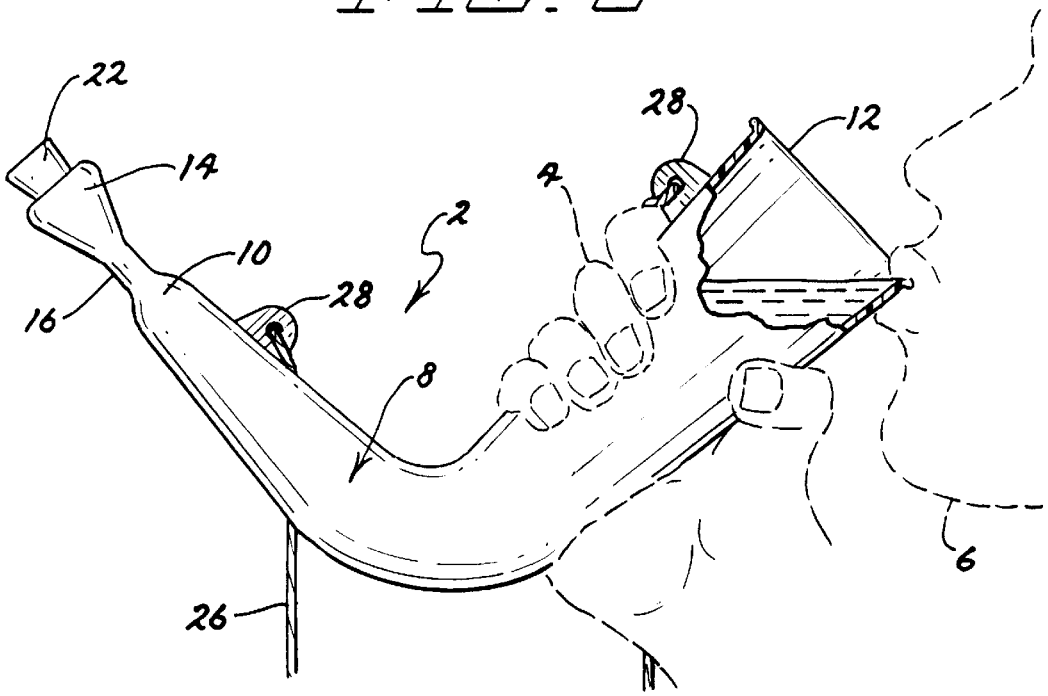
FIG. 2 is a side elevational view of the combined drinking cup and horn of FIG. 1, particularly illustrating use as a cup when drinking a beverage contained inside the cup.

FIGS. 2 and 3 illustrate how drinking cup and horn 2 of this invention is used.

Referring first to FIG. 1 user 6 would normally purchase drinking cup and horn 2 at a sporting event or the like in the condition shown in FIG. 1. In this condition, drinking cup and horn 2 would be filled with some type of beverage and mouthpiece 14 would be closed by stopper 22. Preferably, a lid 24 would cover second end 12 of cup portion 8 to prevent the beverage from spilling.

Referring now to FIG. 2, to drink the beverage, user 6 need only remove lid 24, if cup portion 8 had been sold with a lid 24 in place, to expose the beverage. User 6 can then grip the upper, generally vertical portion of cup portion 8 and drink from cup portion 8, tipping cup portion 8 back as need be. This is clearly shown in FIG. 2. User 6 continues to drink from cup portion 8 until all of the beverage is emptied from cup portion 8, including all of the beverage contained in cup portion 8, neck 16, and mouthpiece 14.

Once cup portion 8 is completely emptied of beverage, either by drinking it or by pouring the beverage out, cup portion 8 can then be used as a noise generating horn. To do this, user 6 simply removes stopper 22 from mouthpiece 14 to open up mouthpiece 14. Mouthpiece 14, neck 16, and cup interior are all appropriately sized and shaped to produce a tonal, horn-like sound when user 6 blows through mouthpiece 14, with most of this sound being produced by mouthpiece 14 and neck 16. FIG. 3 shows user 6 blowing through mouthpiece 14 while gripping the generally horizontal portion of cup portion 8. The blown air flows through mouthpiece 14, reduced diameter neck 16, and cup portion 8 to produce a tone.

Strap or cord 26 is shown in FIG. 2 hanging downwardly from cup portion 8. However, strap or cord 26 could also be placed around the user's neck to help user 6 retain drinking cup and horn 2 around his neck when user 6 is using it as a horn.

Preferably, drinking cup and horn 2 can be injection or blow molded out of plastic in one-piece, except for strap or cord 26 which would be formed separately and tied to eyelets 28 provided on cup portion 8. Closure 20 of opening 18 in mouthpiece 14 could be formed with drinking cup and horn 2 if closure 20 were to be a frangible cap or cover on mouthpiece 14, i.e. a cap or cover that could be broken off after cup portion 8 is emptied of the beverage. In the event of a separate stopper 22 as shown herein, stopper 22 would be formed separately and simply pressed into opening 18 of mouthpiece 14 of drinking cup and horn 2. In any event, the overall cost of drinking cup and horn 2, given the plastic molding described above, would be low enough so that drinking cup and horn 2 could be disposed of after a single use if so desired. Alternatively, the exterior of cup portion 8 could be imprinted with graphics in which case drinking cup and horn 2 might more desirably be retained as a souvenir.

Various modifications of this invention will be apparent to those skilled in the art. For example, the tones produced by drinking cup and horn 2 can be any non-verbal tones such as those produced by horns or whistles. Thus, the scope of the invention shall be limited only by the appended claims.

I claim:

1. A combined drinking cup and horn, which comprises:

a cup portion for holding a beverage as a user drinks the beverage through an open end of the cup portion;

a selectively openable mouthpiece attached to the cup portion, wherein a non-verbal sound is produced when the mouthpiece is opened after the beverage is emptied from the cup portion and the user blows through the mouthpiece in the manner of a horn.

2. The drinking cup and horn of claim 1, wherein the mouthpiece is connected to the cup portion by a neck of smaller size than the mouthpiece or that section of the cup portion to which the neck connects.

3. A combined drinking cup and horn, which comprises:

a cup portion for holding a beverage as a user consumes the beverage;

a mouthpiece on the cup portion having an opening;

a removable closure on the opening of the mouthpiece to prevent the beverage from leaking from the cup portion through the mouthpiece as the beverage is being consumed; and wherein the mouthpiece and cup portion provide a tonal, horn-like sound when the user blows through the mouthpiece after the cup portion has been emptied of the beverage and the closure on the mouthpiece is removed.

4. The drinking cup and horn of claim 3, wherein the cup portion has first and second ends with the cup portion progressively increasing in cross-sectional size between the first and second ends thereof.

5. The drinking cup and horn of claim 4, wherein the second end of the cup portion is of a size sufficient to allow the user to drink from the second end of the cup portion.

6. The drinking cup and horn of claim 5, wherein the mouthpiece is attached to the first end of the cup portion.

7. The drinking cup and horn of claim 6, wherein the mouthpiece is attached to the first end of the cup portion by a reduced diameter neck.

8. The drinking cup and horn of claim 6, wherein a removable lid is provided for initially closing the second end of the cup portion.

9. The drinking cup and horn of claim 4, wherein the first and second ends of the cup portion are disposed at an angle relative to one another.

10. The drinking cup and horn of claim 9, wherein the first and second ends of the cup portion are disposed at a 90° angle relative to one another such that the cup portion is substantially L-shaped between its first and second ends.

11. The drinking cup and horn of claim 3, wherein the closure preventing beverage flow through the opening of the mouthpiece comprises a removable stopper inserted into the mouthpiece opening.

12. The drinking cup and horn of claim 11, wherein the removable stopper is made of rubber.

13. The drinking cup and horn of claim 3, wherein the mouthpiece is attached to the first end of the cup portion by a reduced diameter neck.

14. A combined drinking cup and horn, which comprises:

a cup portion for holding a beverage, the cup portion having a first end and a second end with circular cross-sections with the cross-section of the cup portion at the first end thereof being smaller than the cross-section of the cup portion at the second end thereof, and wherein the cross-section of the cup portion at the second end thereof is sufficiently large to allow a user to drink the beverage from the second end of the cup portion;

a mouthpiece attached to the first end of the cup portion through a reduced diameter neck;

a closure for the mouthpiece to prevent the beverage from passing out of the mouthpiece when a beverage is contained in the cup portion and the beverage is being consumed by the user, the closure being removable from the mouthpiece when the cup portion is empty to open the mouthpiece, the reduced diameter neck and the cup portion to allow the user to blow therethrough to create a tone.

15. The drinking cup and horn of claim 14, wherein the cup portion is generally L-shaped between its first and second ends such that a section of the cup portion adjacent the second end is generally vertical when a section of the cup portion adjacent the first end is generally horizontal.

16. The drinking cup and horn of claim 15, wherein the generally vertical section of the cup portion adjacent the second end thereof is long enough to allow the user to grip the generally vertical section of the cup portion with one hand when drinking from the second end of the cup portion.

17. The drinking cup and horn of claim 15, wherein the generally horizontal section of the cup portion adjacent the first end thereof is long enough to allow the user to grip the generally horizontal section of the cup portion with one hand when blowing through the mouthpiece.

* * * * *